US007753055B2

(12) United States Patent
Bryman

(10) Patent No.: US 7,753,055 B2
(45) Date of Patent: Jul. 13, 2010

(54) INTEGRATED SMOKING DEVICE

(76) Inventor: Gary Bryman, 16 Fleet St., Venice, CA (US) 90292

( * ) Notice: Subject to any disclaimer, the term of this patent is extended or adjusted under 35 U.S.C. 154(b) by 1198 days.

(21) Appl. No.: 11/260,018

(22) Filed: Oct. 26, 2005

(65) Prior Publication Data

US 2007/0089757 A1 Apr. 26, 2007

(51) Int. Cl.

| | |
|---|---|
| ***A24D 1/10*** | (2006.01) |
| ***A24F 1/10*** | (2006.01) |
| ***A24F 9/10*** | (2006.01) |
| ***A24F 3/00*** | (2006.01) |
| ***A24F 47/00*** | (2006.01) |

(52) U.S. Cl. ..... 131/351; 131/330; 131/184.2; 131/185

(58) Field of Classification Search ..... 131/351, 131/330, 184.2, 185

See application file for complete search history.

(56) References Cited

U.S. PATENT DOCUMENTS

| | | | | |
|---|---|---|---|---|
| 3,211,158 | A * | 10/1965 | Shih et al. | 131/173 |
| 3,422,821 | A * | 1/1969 | Calkins | 131/195 |
| 3,564,341 | A * | 2/1971 | Nishiura | 361/247 |
| 3,986,516 | A | 10/1976 | Brooks | |
| 4,214,658 | A | 7/1980 | Crow | |
| 4,276,892 | A * | 7/1981 | Iaquinta | 131/185 |
| 4,810,187 | A | 3/1989 | Nitta | |
| 5,145,357 | A | 9/1992 | Chou | |
| 5,465,738 | A | 11/1995 | Rowland | |
| 5,580,239 | A | 12/1996 | Jang | |
| 5,848,596 | A * | 12/1998 | Zelenik | 131/329 |
| 6,196,232 | B1 * | 3/2001 | Chkadua | 131/222 |
| 6,418,936 | B1 | 7/2002 | Lee | |
| 6,598,607 | B2 | 7/2003 | Adiga et al. | |
| 2004/0187879 | A1 * | 9/2004 | Iordan | 131/194 |

* cited by examiner

*Primary Examiner*—Khanh Nguyen
*Assistant Examiner*—Matthew Hoover
(74) *Attorney, Agent, or Firm*—J. Curtis Edmondson

(57) ABSTRACT

A smoking device having an integrated lighter, a bowl for holding tobacco, and a duct for drawing smoke like a pipe. The device consists of a ignition switch located on the side of the pipe in natural proximity to the thumb, a piezo-electric ignition system, a flammable gas delivery system, a bowl for holding smoking material, and an aperature for drawing tobacco.

11 Claims, 8 Drawing Sheets

INTEGRATED SMOKING DEVICE

BACKGROUND

The present invention relates to a device for smoking materials in general, and for smoking tobacco in particular.

Smoking pipes are well known in the arts. A typical pipe consists of circular bowl with a depression for holding shredded or granulated vegetable matter (hereinafter "smoking material"). The base of the bowl has a small hole that is connected to a pipe. The user of the smoking pipe breathes air in through pipe, which draws air through the smoking material. The user of the smoking pipe ignites the smoking material while drawing air through the pipe. The smoke from the ignited material is then drawn into the lungs of the user via the pipe during the inhalation process.

The process of smoking consists of two separate devices. There is a bowl that holds the smoking material and the ignition device. The impracticality of the two devices is that sometimes the user must look for an ignition device. The common phrase, "Do you have a light?", albeit serving the purpose of social interaction, does not alleviate the problem of looking for a lost matchbook or a lighter.

Relevant prior art includes well known devices, such as regular pipes, or water pipes, also known as hookums. These devices lack an integrated lighting mechanism.

U.S. Pat. No. 3,986,516 (1976) to Brooks describes a system whereby tobacco is ignited with an electric heater surrounding the tobacco. This does not describe an smoking system that combines a gas ignition device with tobacco.

U.S. Pat. No. 4,214,658 (1980) to Crow describes a system that holds a smoking pipe and the smoking material in a compact container. This device is different from the presently claimed device because it lacks an integrated lighting device.

U.S. Pat. No. 4,276,892 (1981) to laquinta describes a system that integrates a lighting system, a fuel supply system, and a bowl to hold the tobacco.

U.S. Pat. No. 4,810,187 (1989) to Nitta describes a piezo electric lighter for lighting pipes. This lighter does not have an area for holding tobacco.

U.S. Pat. No. 5,145,357 (1992) to Chou describes a lighter without a bowl for holding the tobacco.

U.S. Pat. No. 5,465,738 (1995) to Rowland similar to the '658 patent (Crow) in that it is simply a container for smoking devices and implements and not an integrated assembly.

U.S. Pat. No. 5,580,239 (1996) to Jang describes a lighter shaped like a pen. This device does not have an integrated system for holding tobacco and the ability to light the tobacco.

U.S. Pat. No. 5,848,596 (1998) to Zelenik describes a smoking assembly which has a separate area for holding tobacco, a smoking pipe, and an ignition device. This device does not depict an integrated assembly to deliver the tobacco. Also the use of the device requires the removal of a pipe, adding the smoking material, and then igniting the smoking material. This operation requires the use of both hands.

U.S. Pat. No. 6,418,936 (2002) to Lee describes a smoking device with six bowls. This device does not have an integrated lighting system for the tobacco nor does it contain a fuel source. Likewise, the bowls must be manually rotated.

U.S. Pat. No. 6,598,607 (2003) to Adiga describes a device that heats a flavor device. This device does not use commonly available tobacco and therefore it's widespread use is limited to those who provide the 'flavor devices'.

None of the aforementioned prior art teaches the use of an integrated smoking device that combines the practicability of an integrated gas lighter, bowl, and ignition device wherein the device does not have an external venting tube.

It is an object of the present invention to provide an integrated smoking device that is includes the fuel source, provides for the storage of a suitable amount of smoking material and has an ignition switch.

It is a further object of the present invention to provide an integrated smoking device that is compact, ergonomic, and may operated with the operation of a single hand.

SUMMARY OF THE INVENTION

The present invention provides an integrated smoking device that includes a housing that contains a bowl for holding smoking material, a piezoelectric ignition source, a mechanism for delivering ignitable fuel, a tube to carry smoke to the user, and a cover over the bowl to prevent the smoking material from falling out during transportation.

In a preferred embodiment, the integrated smoking device is of the approximate dimensions to be held in the palm of an adult's hand. The bowl holds the smoking material. A retractable cover is positioned over the bowl and can be slid to cover the bowl. Within the bowl there are three apertures. The first aperture provides a spark source, the second aperture provides a source of gas, and the third aperture provides a passage to carry smoke to the user. Internal to the device are tubes connecting the corresponding apertures in the bowl. There is a tube to transport the spark source, a second tube to transport the source of gas, and third tube to carry smoke to the user. The ignition source is controlled by a piezoelectric switch located on the side of the housing. Likewise the flow of gas from the gas source is controlled by the piezo electric switch.

A typical use of the integrated smoking device consists of the user opening the retractable cover, placing a small amount of smoking material into the bowl, depressing the piezoelectric switch. This ignites the source of gas, while also igniting the smoking material. As the smoking material burns, the user pulls air in through the third aperture, via his or her mouth, which correspondingly draws in smoke into the users lungs.

The housing may be of suitable construction consisting of either metal or plastic. The materials being selected to satisfy certain durability and cost objectives. Likewise, internal components may be constructed of various materials to satisfy the requirements of the device. For example, the bowl may be constructed of a ceramic or metal to withstand the heat created upon ignition. The internal tubes are also constructed from materials that satisfy their design requirements, for example, the tube that connects the fuel source to the bowl should be non-reactive with the type of fuel utilized.

DETAILED DESCRIPTION

While describing the invention and its embodiments various terms will be used for the sake of clarity. These terms are intended to not only include the recited embodiments, but also all equivalents that perform substantially the same function, in substantially the same manner to achieve the same result.

Figure 1A:
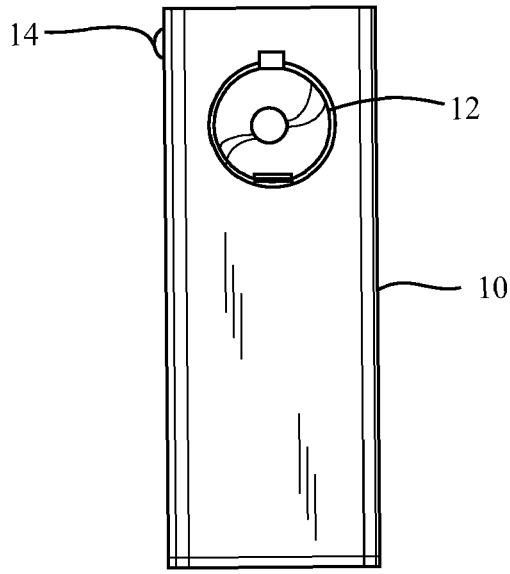
FIG. 1A is a top exterior view of the integrated smoking device with the bowl exposed and the ignition switch on the left hand side of the smoking device.
Figure 1B:
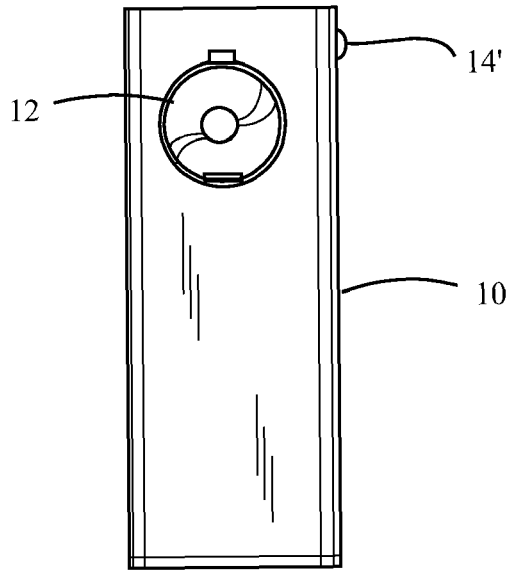
FIG. 1B is a top exterior view of the integrated smoking device with the bowl exposed and the ignition switch on the right hand side of the smoking device.

One embodiment of the integrated smoking device 10 is shown in FIG. 1A and FIG. 1B, illustrating a top view of the device. The device as shown in FIG. 1A consists of a bowl 12 for holding smoking material with a piezoelectric ignition switch 14. The device as shown in FIG. 1B is essentially the same as FIG. 1A but the piezoelectric switch 14' is mounted on the opposite side.

Figure 2:
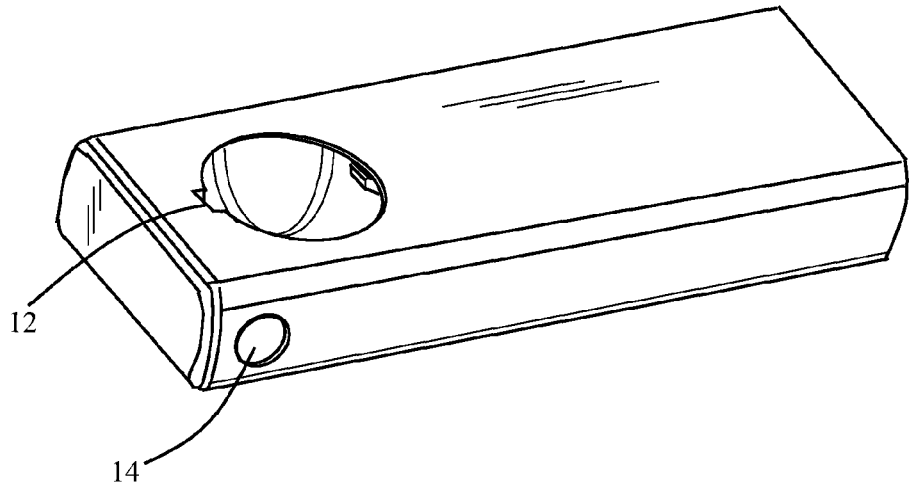
FIG. 2 is a side exterior view of the integrated smoking device with the bowl exposed and a complete view of the ignition switch.

The integrated smoking device in FIG. 2 illustrates a side perspective of the device including the bowl 12 and the piezoelectric switch 14.

Figure 3A:
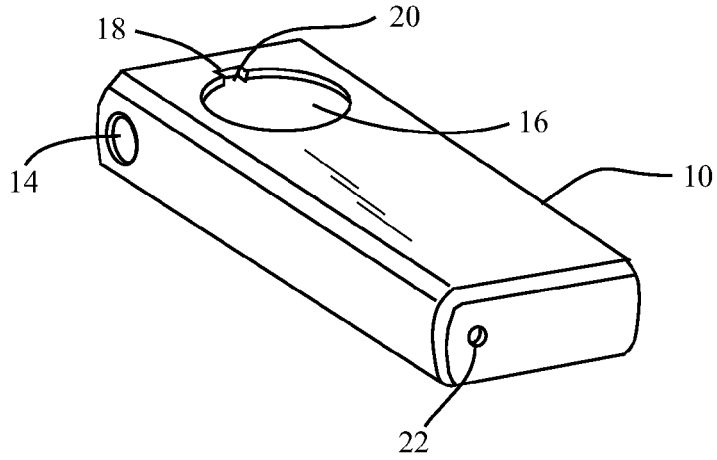
FIG. 3A is a side exterior view of the integrated smoking device with the cover pulled over the bowl and a view of the ignition switch and the hole for drawing smoke.

The integrated smoking device 10 as illustrated in FIG. 3A depicts a side perspective with the cover 16 closed over the bowl 12. The cover 16 is held in place by via a depression 18 located in the housing that is held by a mechanical latch 20. Smoke from the integrated smoking device is drawn through the duct 22.

Figure 3B:
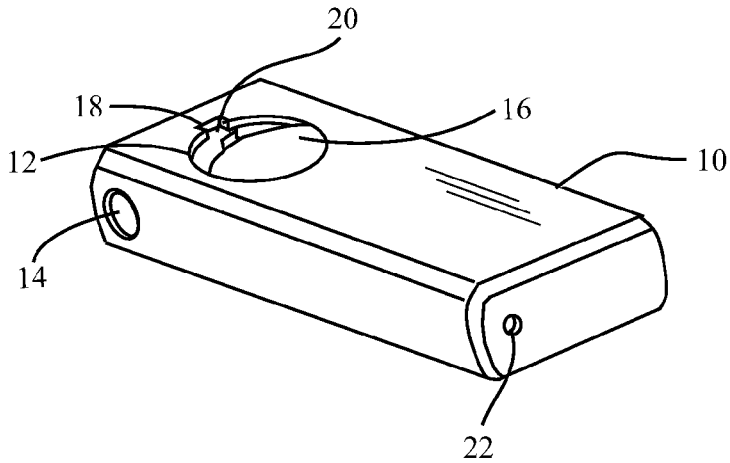
FIG. 3B is a side exterior view of the integrated smoking device with the cover drawn partially back over the bowl.

The integrated smoking device 10 as illustrated in FIG. 3B depicts a side perspective with the cover 16 partially open.

Figure 4:
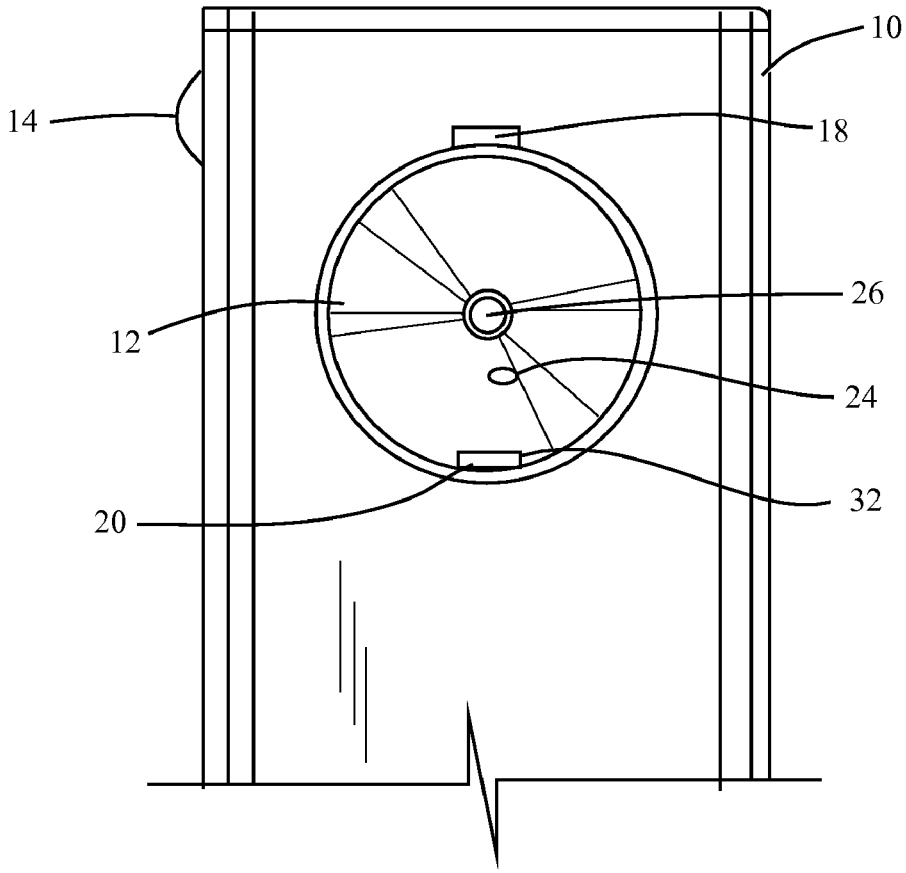
FIG. 4 is a close up view of the upper portion of the integrated smoking device with the bowl exposed.

The integrated smoking device as illustrated in FIG. 4 depicts a detailed top view of the bowl 12, the piezoelectric switch 14, the mechanical latch 20, the spark source (not visible), the gas aperture 24, and the smoke aperture 28.

Figure 5:
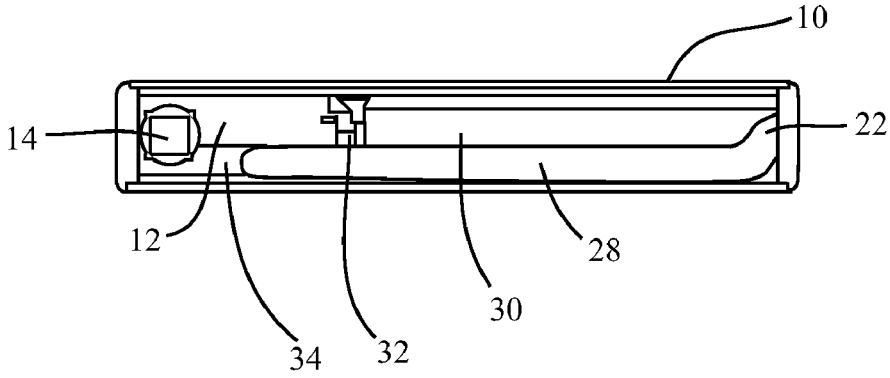
FIG. 5 is a side view of the integrated smoking device depicting the internal components.

The integrated smoking device 10 as illustrated in FIG. 5 depicts a side cut-out view of the internal components. The bowl 12 is connected to the smoke aperture 26 via a smoke tube 28. The bowl 12 is connected to the fuel source 30 via a fuel tube 32. The control of the fuel source is by ribbon strip 34 connected to a valve on the fuel source 30.

Figure 6A:
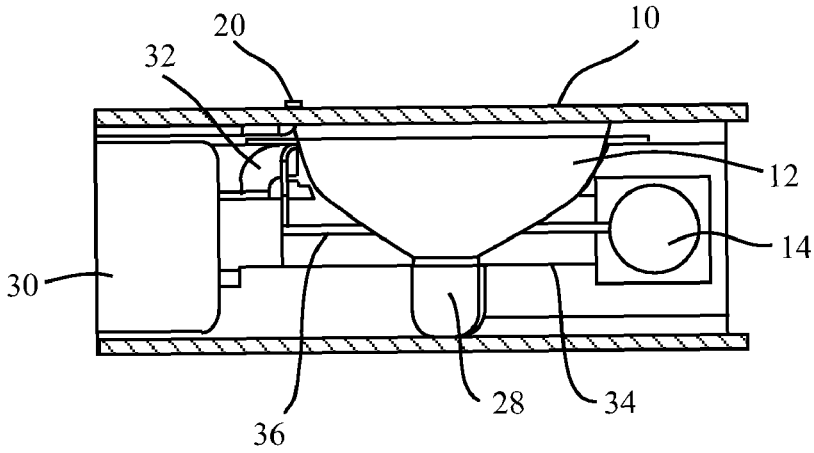
FIG. 6A is a close up side view of the integrated smoking device depicting the internal components.

The integrated smoking device 10 as illustrated in FIG. 6A depicts a close-up sidecut-out view of internal components near the top of the bowl 12. The piezoelectric switch 14 is connected to the aperture of the fuel source30 via a wire 36.

Figure 6B:
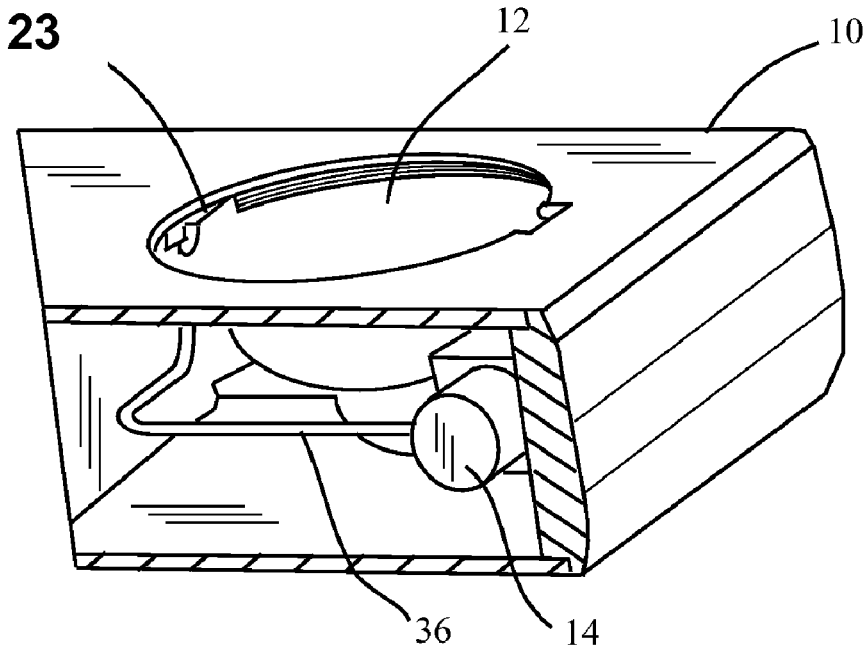
FIG. 6B is a close up rotated side view of the integrated smoking device depicting the internal components.

The integrated smoking device 10 as illustrated in FIG. 6B depicts a close-up side rotated cut-out view of the internal components near the top of the bowl 12. This drawing further illustrates the wire 36 connected to the piezoelectric switch 14 and the fuel source 30. An electric spark is created at the spark source 23.

Figure 7:
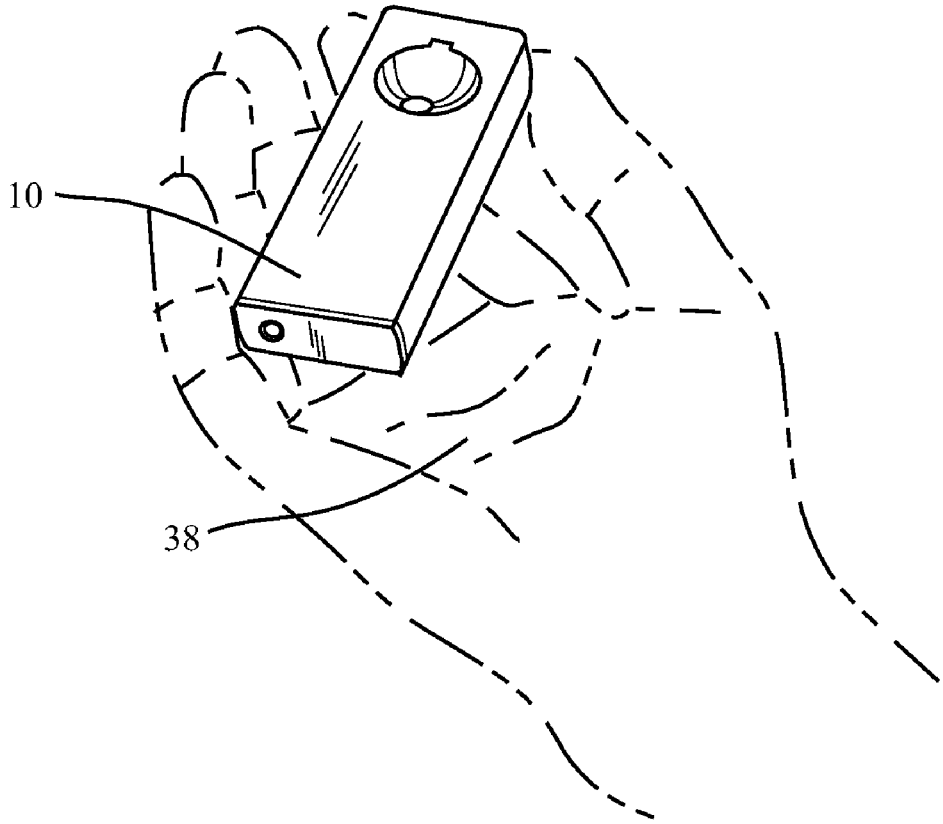
FIG. 7 is a side exterior view of the integrated smoking device held in the palm of the hand of a smoker.

The approximate size of the integrated smoking device 10 is illustrated in FIG. 7. The device is held in the palm 38 of the hand of the user.

To process of using the integrated smoking device 10 will typically consist of the user opening the cover 16 covering the bowl 12. Smoking material is placed in the bowl 12. The user holds the integrated smoking device 10 to his or her mouth. The piezoelectric switch 14 is depressed. When the piezoelectric switch 14 is depressed a ribbon strip 34 connected to a control valve on the gas source 30 causes gas to flow through the gas aperture. Simultaneously, the depression of the piezoelectric switch 14 causes a current to flow in the wire 36 which creates a spark source 23.

While the embodiments of the invention have been described in detail and shown in the accompanying drawing, it will be evident that various further modifications are possible without departing from the scope of the invention as set forth in the following claims.

I claim:

1. An integrated smoking device for smoking material comprising:

a housing, a bowl, the bowl contained within the housing; the bowl further comprising a top part and a bottom part, the top part being approximately circular, and the bottom part being circular; the top part being larger in area than the bottom part, wherein the top part is generally parallel to the bottom part and the center of the top part is approximately centered over the bottom part, and bowl walls connecting the top part and the bottom part; such that the top part and bottom part are fully contained within the housing wherein the bowl further comprises a first bowl aperture, a second bowl aperture, and a third bowl aperture; and a first tube, a second tube, and a third tube, the first tube, the second tube, and the third tube substantially contained within the housing;

a switch, wherein the bowl further comprises a movable cover associated with the housing for opening and closing over the top part of the bowl;

a third tube for transporting smoke; the third tube mechanically connected to the third bowl aperture to a user;

a gas source substantially contained within the housing connected to a second, tube said second tube connected to the second bowl aperture;

a gas source, the gas source substantially contained within the housing;

a spark source, the spark source substantially contained within the bowl, the spark source capable of emitting a spark, such that the spark source is capable of igniting the gas source and the spark source is mechanically connected to the first bowl aperture by the first tube , wherein when the switch is depressed gas flows from the gas source and the gas is ignited by the spark source, so that the smoking material ignites and the smoke emitted from the smoking material may be drawn through the third tube by the user.

2. The integrated smoking device of claim 1 wherein the gas source is butane.

3. The integrated smoking device of claim 1, wherein the housing has dimensions to approximately fit in the palm of a an adult human hand.

4. The integrated smoking device of claim 1, wherein the spark source is controlled by the switch, and wherein the switch is placed substantially within a housing.

5. The integrated smoking device of claim 1 wherein the third tube for drawing smoke is integral to the housing and located substantially on the side opposing the switch.

6. The integrated smoking device of claim 1, wherein the housing is constructed with plastic material.

7. The integrated smoking device of claim 1, wherein the spark source is created by an electrical impulse.

8. The integrated smoking device of claim 1 wherein the bowl is a ceramic material.

9. The integrated smoking device of claim 1 further comprising a cover to substantially cover the bowl that is slideably mounted to the housing.

10. The integrated smoking device of claim 1 wherein the housing has the approximate shape of a rectangular prism.

11. The integrated smoking device of claim 1 wherein the housing has the approximate dimensions of 3 ⅜ inches by ½ inch by 1 ¹¹⁄₂ inches.

* * * * *